US008082859B2

(12) United States Patent
Sevack

(10) Patent No.: US 8,082,859 B2
(45) Date of Patent: Dec. 27, 2011

(54) BLIND SHELF SUPPORT AND METHOD OF INSTALLATION

(76) Inventor: Lloyd Sevack, Quebec (CA)

( * ) Notice: Subject to any disclaimer, the term of this patent is extended or adjusted under 35 U.S.C. 154(b) by 1100 days.

(21) Appl. No.: 11/606,607

(22) Filed: Nov. 30, 2006

(65) Prior Publication Data

US 2007/0125738 A1 Jun. 7, 2007

Related U.S. Application Data

(60) Provisional application No. 60/741,476, filed on Dec. 2, 2005.

(51) Int. Cl.
*A47B 5/00* (2006.01)

(52) U.S. Cl. ..... 108/152; 248/250

(58) Field of Classification Search ..... 211/134, 211/186, 153, 87.01, 90.01, 119.003; 108/42, 108/152; 248/235, 236, 250
See application file for complete search history.

(56) References Cited

U.S. PATENT DOCUMENTS

| | | | | | |
|---|---|---|---|---|---|
| 2,261,078 | A | * | 10/1941 | Shockey | 108/42 |
| 2,389,349 | A | * | 11/1945 | Eastman | 108/42 |
| 3,033,376 | A | * | 5/1962 | Eastman | 108/42 |
| 3,190,243 | A | * | 6/1965 | Pira | 108/152 |
| 3,333,555 | A | * | 8/1967 | Kapnek | 108/152 |
| 3,527,175 | A | * | 9/1970 | Kapnek | 108/152 |
| 3,718,101 | A | * | 2/1973 | Sacks | 108/152 |
| 3,752,088 | A | * | 8/1973 | Kapnek | 108/152 |
| 4,167,145 | A | * | 9/1979 | Preslow | 108/152 |
| 4,381,715 | A | * | 5/1983 | Forman | 108/152 |
| 4,441,433 | A | * | 4/1984 | Caldwell | 108/152 |
| 5,954,306 | A | * | 9/1999 | Hoover | 248/250 |
| 6,164,610 | A | * | 12/2000 | Santiago | 248/235 |
| 6,467,636 | B1 | * | 10/2002 | Schaefer | 211/90.01 |
| 6,615,745 | B2 | * | 9/2003 | Cinkaj | 108/152 |

FOREIGN PATENT DOCUMENTS

EP 5450393 A1 * 7/1993

OTHER PUBLICATIONS

Hexagon Support Bolt, Sun Chain Trading Company, Ltd., 1 Page 2006.

* cited by examiner

*Primary Examiner* — Darnell Jayne
*Assistant Examiner* — Stanton L Krycinski
(74) *Attorney, Agent, or Firm* — Alfred M. Walker

(57) ABSTRACT

A stable mountable blind shelf support is mounted upon a wall having wall studs. A blind shelf mount for a shelf includes either a mounting disk or a baseplate with fasteners and a support post, such as a hex post, and is attached by further fasteners to a wall stud. Prior to installation, the wall is marked with mounting locations on the back edge of a shelf by transferring impressions from the support post or fasteners. Lines are scribed using a carpenter's square at each location of an impressed mark; then the midpoint of thickness at each site is marked. A counterbore is formed at each marked site on the back edge of the shelf and then the location of the drilled post holes is derived. The holes thus formed accept posts formed for two or more routed recesses in registration with each other in the finished laminated built-up shelf.

11 Claims, 4 Drawing Sheets

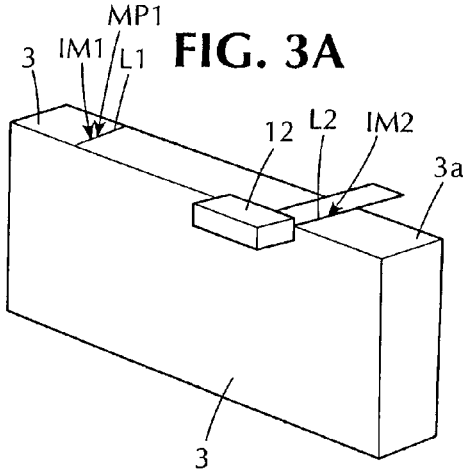
FIG. 3A
FIG. 3B
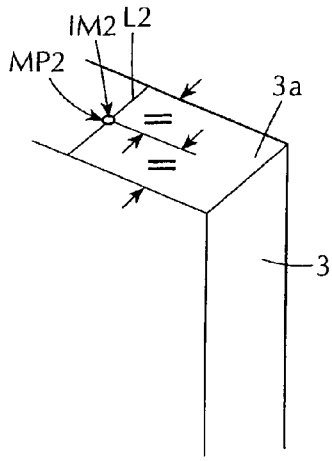
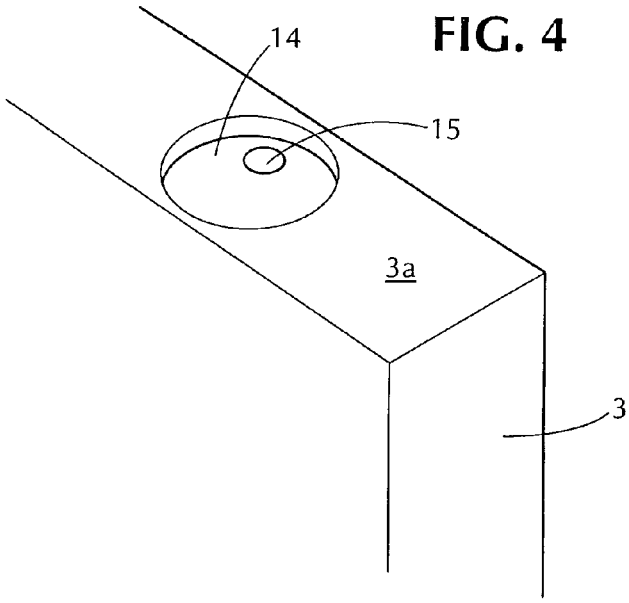
FIG. 4

BLIND SHELF SUPPORT AND METHOD OF INSTALLATION

RELATED APPLICATIONS

This application is based upon provisional application No. 60/741,476, filed Dec. 2, 2005, and claims priority under 35 United States Code §119 therefrom.

FIELD OF THE INVENTION

The present invention relates to wall mounted blind shelf supports and methods of installation thereof.

BACKGROUND OF THE INVENTION

Wall mount shelf supports typically remain visible once the shelf is installed. In a typical stud wall, a wall mounted shelf is preferably mounted such that fasteners are driven into the studs for maximizing the load capacity of a shelf.

A blind shelf support designed to be fastened to wall studs whereby no support element is visible while offering substantial load capacity and ease of installation is not known in the prior art.

OBJECTS OF THE INVENTION

It is therefore an object of the present invention to provide a blind shelf support which can be easily attached to wall studs.

It is also an object of the present invention to provide a blind shelf without visible support elements.

It is also an object of the present invention to provide a blind shelf with a strong load capacity.

It is also an object of the present invention to provide a blind shelf and/or blind shelf supports with a simple method of installation.

Other objects which become apparent from the following description of the present invention.

SUMMARY OF THE INVENTION

In keeping with these objects and others which may become apparent, the blind shelf support of this invention has features to enable a homeowner, builder, or renovator with basic woodworking tools and skills to quickly fabricate a shelf and install it.

A blind shelf support system is provided for attaching a shelf to a wall having studs, wherein the shelf is attached to the wall without any visible means of shelf attachment. The shelf has a rear edge which contacts the wall, wherein the shelf rear edge has at least two post-accommodating recesses therewithin. The recesses are created at respective locations on the rear edge. These locations are determined by a means to transfer the appropriate shelf hardware mounting location for the shelf into the rear edge of the shelf. These recesses are hardware mounting chambers for installing the shelf-mounting hardware, such as posts, within the shelf itself, while permitting the rear edge of the shelf to fit flush against the wall, thereby hiding the mounting system of the shelf from view. The means to transfer the shelf hardware mounting location may include at least a pair of removable posts, each post exposing a pointed element extending from each wall mounted plate of the shelf mounting hardware, wherein each pointed element defines the appropriate location for the posts of the shelf mounting hardware. Alternatively, the means to transfer the shelf hardware mounting location may include at least a pair of posts, each post being affixed to a respective base plate of the shelf mounting hardware, wherein each post has a pointed element extending at a distal end thereof defining the appropriate location for each post of the shelf mounting hardware. Each pointed element may impart an indentation into the respective rear edge of the shelf, or may impart a visible indicia, such as ink, onto the appropriate location for the posts of the shelf mounting hardware.

In a first embodiment, a round mounting disk is provided for each stud support to be used in supporting the shelf (two or more). The mounting disk has a plurality of holes, such as two holes, which are spaced apart from each other. The top hole receives a protruding fastener, such as, for example, a lag bolt (with optional washer) which is used for attachment to a wall stud. The bottom hole is threaded to accept a further fastener, such as, for example, a pointed set screw, preferably made of alloy steel or other strong material.

After the mounting disks are attached to the wall with the pointed set screws installed and facing away from the wall, the back of the shelf is brought into contact with the protruding set screws and pushed or tapped against them so as to leave impressions on the back edge. A carpenter's square is then used to scribe lines across the back edge of the shelf at the marks left by the set screws, thereby transferring the exact distance between the mounted disks. A counterbore slightly larger in diameter than the disk diameter is then formed on the back edge of the shelf at each marking site and centered on the thickness of the shelf. While dimensions may vary, in a preferred embodiment, the depth is approximately ⅜ inch. The shelf is again brought into contact with the set screws, but now the marks of the set screws are within the counterbores which encircle each mounting disk.

While other dimensions may be used, in a preferred embodiment, a 7⁄16 inch diameter hole 5¼ inch deep (or slightly longer than the length of the hex posts) is carefully drilled into the rear edge of the shelf at each set screw mark within each counterbore (perpendicular to the rear edge in two orthogonal directions). The last part of each blind shelf support is a polygonal crossection post (such as a hexagonal crossection post, for example,) with a threaded blind hole at one end. One of these parts is screwed in firmly onto the set screw of each of the mounting disks. The shelf is then simply pushed against the protruding ends of the hex post completing the installation. The shelf seats flush against the wall covering the mounting hardware completely since the counterbore provides space to accept the mounting disk as well as the head of the lag bolt.

By attaching the mounting plate as close as possible to the top of its periphery, resistance to cantilevering away from the wall is resisted since the entire surface area below the affixing point is under compression against the wall. Also, this large area of mounting disk below the fastener resists pushing into the wallboard since the compressive loading force is translated over a larger area with resultant reduced surface pressure. The fasteners, such as alloy steel set screws, become tensioned when the attached hex posts are tightened, offer great resistance to bending. These factors all contribute to minimize shelf sag.

In a second embodiment, the mounting disks are replaced by rectangular mounting baseplates with a central threaded hole to receive the set screw and two countersunk mounting holes near the top edge to receive two flat head mounting screws. In this embodiment, the preferably 7⁄16 inch diameter holes for the hex posts are drilled in the center of the thickness of the shelf. This also makes it practical for built-up shelves to be made of the lamination of two thinner pieces of wood, which may be of equal thickness. Instead of drilling the back edge of the built-up shelf for the hex posts, at the appropriate sites ½ inch wide x 7/32" deep grooves (7/32" being half the size of the hex shaft as measured across its opposing corners) grooves preferably 5¼ inch long (or slightly longer than the length of the hex posts) are routed from the rear edge of each of the two boards which will be joined with the grooves facing one another to form the hole.

Since the baseplates with the flathead mounting screws protrude much less from the wall surface than the mounting disks with lag screw head of the first embodiment, a shelf can just be attached by pushing it against the baseplates, leaving it slightly away from the wall. If this is not acceptable, while exact dimensions may vary, preferably a 1 inch by 2 inch by ⅛ inch deep recess at each baseplate or a preferably 1 inch wide ⅛ inch deep slot on the entire back edge of the shelf can be used to provide the clearance for the baseplates thereby permitting the shelf to be mounted flush against the wall.

BRIEF DESCRIPTION OF THE DRAWINGS

The present invention can best be understood in connection with the accompanying drawings. It is noted that the invention is not limited to the precise embodiments shown in drawings, in which:

FIGS. 3A and 3B is a perspective view and a detail view of the step of scribing the back edge of the shelf at the impressed marks;

FIG. 4 is a perspective detail showing the location of hex post hole to be drilled within a counterbore on the back edge of a shelf;

DETAILED DESCRIPTION OF THE INVENTION

Figure 1:
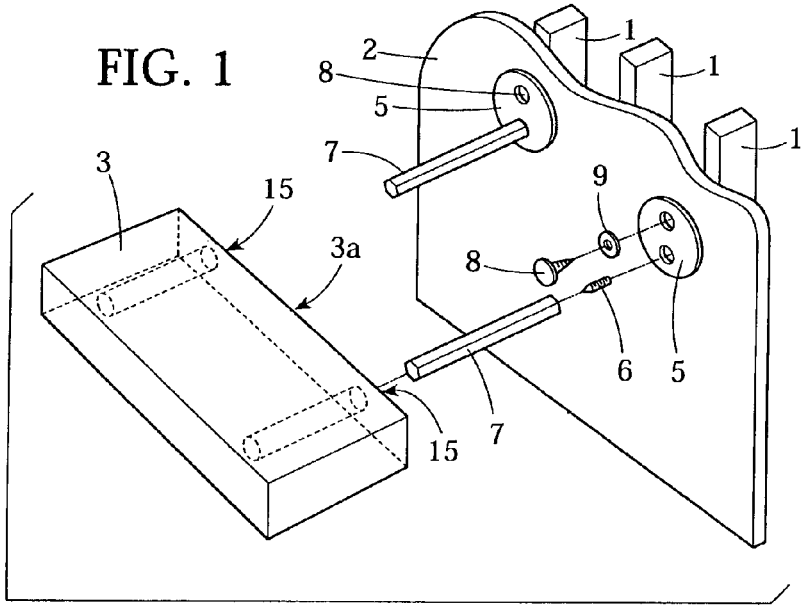
FIG. 1 is a perspective view with an exploded section showing all of the parts of the first embodiment blind shelf support of this invention.

FIG. 1 shows a wall having wall studs 1 and wall covering 2 such as sheet rock. A blind shelf mount of the first embodiment for shelf 3 includes mounting disk 5 with fasteners, such as pointed set screw 6 and a support post, such as hex post 7, and is attached by further fasteners, such as lag screw 8 and washer 9 to stud 1.

Figure 2:
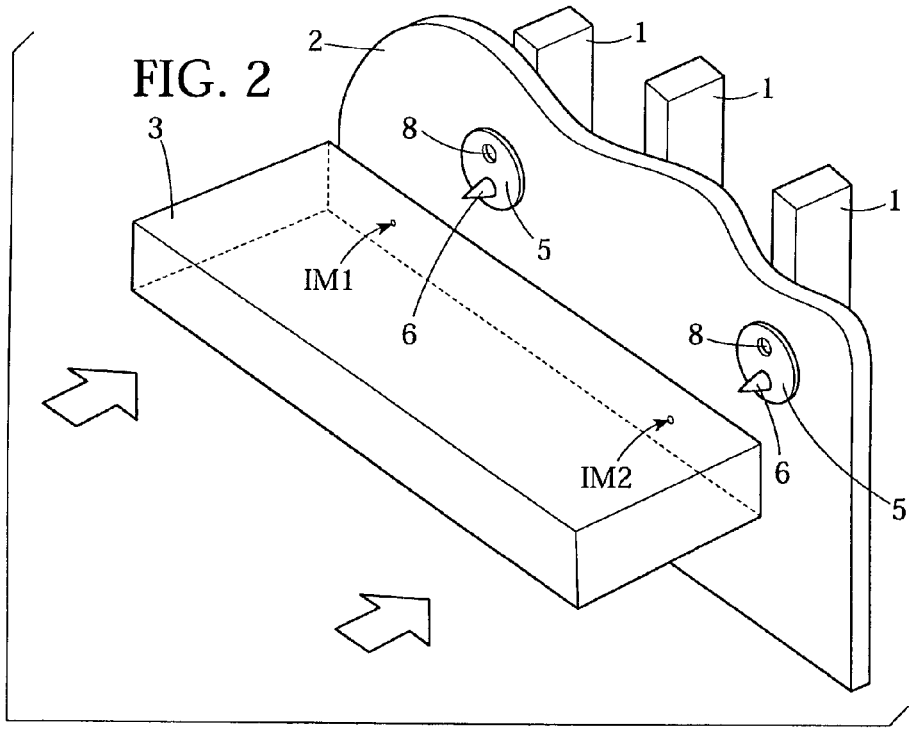
FIG. 2 is a perspective view of the step of using the pointed set screws to mark the back edge of the shelf.

FIG. 2 shows the step of marking the mounting locations on the back edge 3*a* of shelf 3 by transferring impressions IM1 and IM2 from pointed elements, such as, for example, set screws 6.

The next step in the process is scribing lines L1 and L2 using a carpenter's square 12 at each location of an impressed mark; then the midpoint MP1 and MP2 of thickness at each site is marked as shown in FIGS. 3A and 3B. Use of defining the midpoint1 MP1 and MP2 is required in case original impressions IM1 and IM2 from set screws 6 or other pointed elements are slightly off center from the center of the rear edge 3*a* of shelf 3. For example, FIG. 3A shows impression mark IM1 slightly off center on line L1. However, mid point MP1 is correctly located on the mid point of line L1. As shown in FIG. 3B, such an adjustment is not necessary, where impression IM2 is shown being at the same location as determined midpoint MP2 of line L2.

A counterbore 14 is formed as shown in FIG. 4 at each marked site on the back edge of shelf 3. By a second marking pass, the location 15 of the drilled hex post holes is derived.

Figure 5:
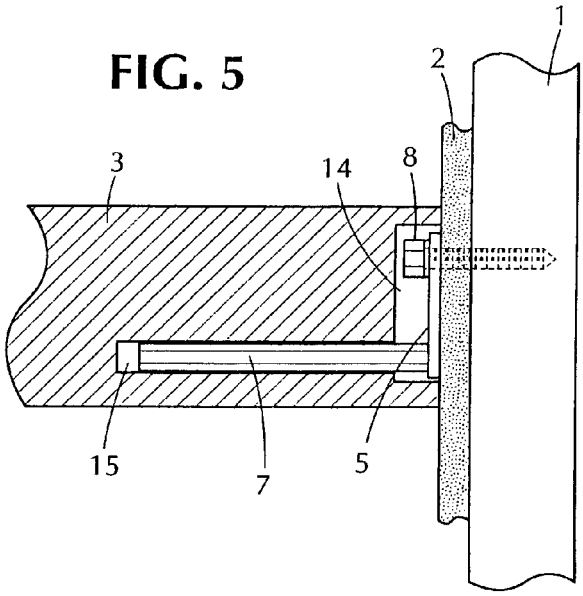
FIG. 5 is a side view detail in partial crossection showing the clearance provided for a mounting disk and lag screw head by the counterbore.

The side view detail of FIG. 5 shows the clearance afforded for mounting plate 5 and lag bolt 8 head by counterbore 14 drilled within rear edge 3*a* of shelf 3.

Figure 6:
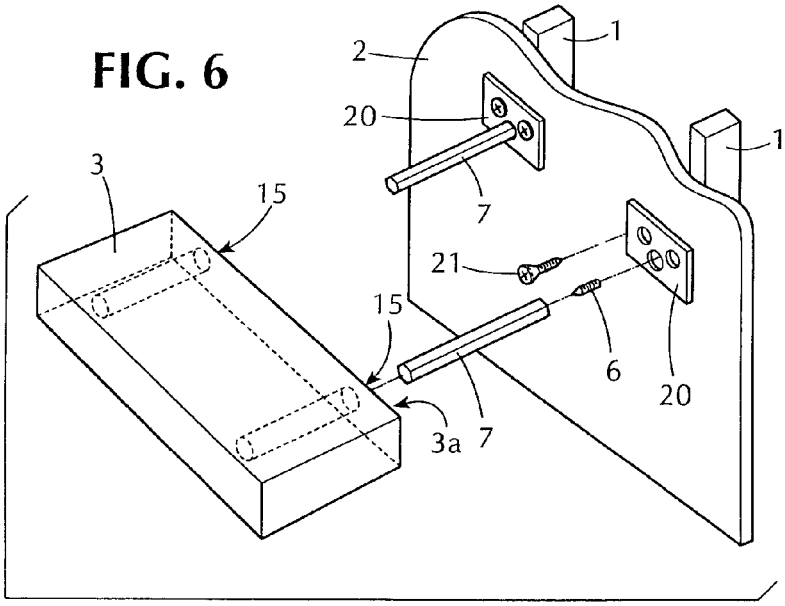
FIG. 6 is a perspective view and an exploded view of the various parts of the second embodiment of this invention using rectangular baseplates.

FIG. 6 shows the baseplates 20 that are used instead of the mounting disks of the first embodiment. This second embodiment uses fasteners, such as two flathead screws 21, to mount each baseplate 20 in to upper countersunk holes. The preferable third hole is centrally located and is threaded to accept set screw 6.

Figure 7A:
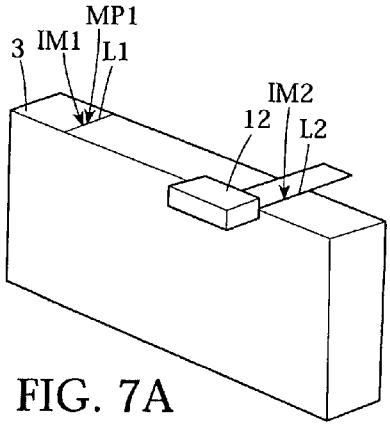
FIGS. 7A and 7B are a perspective view and a detail view of the step of scribing lines at impressed marks and marking the mid-point of the thickness for the second embodiment.
Figure 7B:
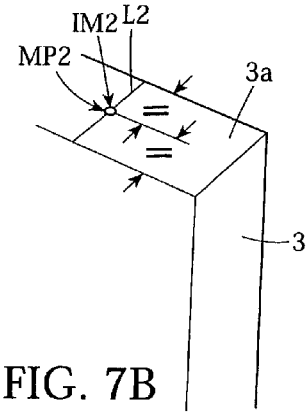

FIGS. 7A and 7B show the step of scribing marks at the impressed marks formed by the set screws 6. Marks for the 7/16 inch diameter holes 15 for hex post 7 are marked at the center of the thickness of the back edge 3*a* of shelf 3. In this embodiment, there is only one step of marking using the pointed set screws. As in FIGS. 3A and 3B, use of defining the midpoint1 MP1 and MP2 is required in case original impressions IM1 and IM2 from set screws 6 or other pointed elements are slightly off center from the center of the rear edge 3*a* of shelf 3. For example, FIG. 7A shows impression mark IM1 slightly off center on line L1. However, mid point MP1 is correctly located on the mid point of line L1. As shown in FIG. 7B, such an adjustment is not necessary, where impression IM2 is shown being at the same location as determined midpoint MP2 of line L2.

Figure 8:
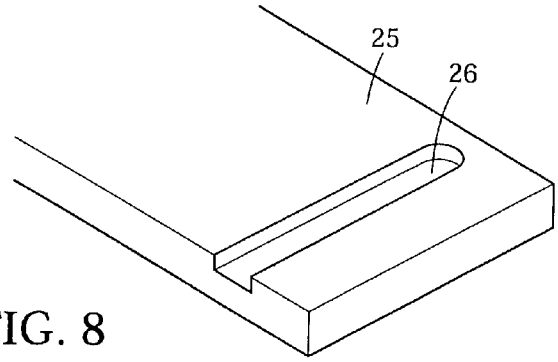
FIG. 8 is a perspective detail of a routed groove in one half of a built-up shelf to accept the hex post.

FIG. 8 shows the method of forming rectangular holes to accept hex posts 7 in a built-up shelf 25 which is made of two thicknesses of stock shelving. Recess 26 is routed from the back edge going toward the front of the shelf.

Figure 9:
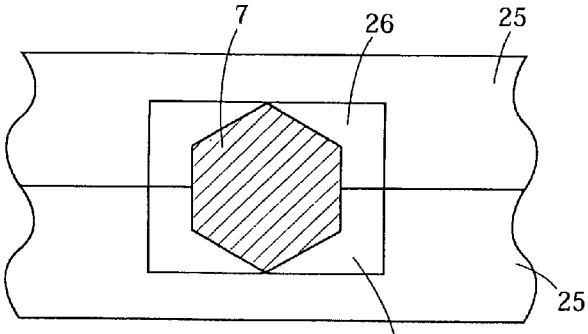
FIG. 9 is a back end view detail showing the rectangular hole with a hex post shown in crossection.

FIG. 9 shows how the hole to accept hex posts 7 is formed for two routed recesses 26 in registration with each other in the finished laminated built-up shelf.

EXAMPLES OF INSTALLATION

Wall mount shelf supports typically remain visible once the shelf is installed, either supporting the shelf from below or above. A system that can support shelves with nothing being visible other than the shelf once it is affixed to the wall has obvious advantages.

A pair of these blind shelf supports will magically support a shelf 3, with neither unsightly (nor decorative) brackets showing. Mounting discs 5 or plates 20 are anchored to the wall 2 (studs 1) with screws 8, and the projecting hex posts 7 slip into 7/16 inch drilled holes 15 in the backside 3*a* of the shelf 3. Even if the holes 15 end up slightly undersize, the corners of the hex post 7 will cut their way in. The design ensures that the alloy steel coupling screws remain tensioned between the posts 7 and inserts in the discs 5, yielding a respectable capacity of 100 lbs. for a 4 inches deep shelf and up to 50 lbs. at 8 inches deep, based on the load being evenly distributed. Keeping the load more toward the rear of the shelf 3 will increase the capacity further and decrease deflection.

Additional supports increase the load capacity on shelves 3 longer than 34 inches; each one adds 50 lbs. more capacity at 4 inches deep, and 25 lbs. more at 8 inches deep.

Installation Instructions for Mounting Discs 5

The shelf 3 should be 1½ inch to 2 inches thick; anything less will keep the mounting discs 5 from being hidden, and anything more will make a needlessly heavy (and load robbing) shelf. The user rips the shelf 3 to the desired width (such as, for example, 4-8 inches), and cuts it to length. It should be at least 18 inches long in order to span a pair if 16 inches spaced wall studs 1, but can be as long as the user wishes. Load-bearing capacity can be increased on shelves 3 longer than 34 inches by adding additional supports at each stud 1 that the shelf overlaps. An overview of the system is shown in FIG. 1.

It is noted that based on 3 inch long hex posts 7, the user can make a narrower shelf 3, but the user will have to cut some of the non-threaded end of the hex post 7 off (with a hacksaw), by however much narrower than 4 inches the user makes the user's shelf 3.

For location purposes, the user slides the rare-earth magnet over the approximate area where the user wishes to mount the shelf 3. Using a light touch, the user will feel when the magnet picks up on a drywall screw. When it does, temporarily mark its position with a light pencil mark or piece of tape. The user measures 16 inches over (or any multiple of), and again use the magnet to find a screw. Locating another at 16 inches from the first mark ensures that the user has found the studs 1 and not any errant screws.

The user marks the stud locations at the desired shelf height. If shelf height is critical, it is noted that that the top surface of the shelf 3 will sit ⅜ inch to ½ inch higher than these locations.

If the user is using only two shelf supports, mark two studs whose spacing is as close to the shelf length as possible, less 2 inches.

EXAMPLES 24 inch shelf: 24 inches−2 inches=22 inches, mark two studs 16 inches apart 36 inch shelf: 36 inches−2 inches=34 inches mark two studs 32 inches apart 48 inch shelf: 48 inches−2 inches=46 inches mark two studs 32 inches apart 60 inch shelf: 60 inches−2 inches=58 inches mark two studs 48 inches apart For increased load-bearing capacity on shelves 3 longer than 34 inches, the users uses additional supports and marks each stud 1 that the shelf overlaps. The user checks that the marked locations form a level line, adjusting any that do not.

The user drills 3/16 inch pilot holes at each location, 1¼ inch to 1½ inch deep. Orienting the mounting disc 5 so the hex face of the threaded insert faces the wall, the user fastens one mounting disc 5 per hole using a lag screw 8 (with flat washer 9). Before firmly tightening, the user adjusts the disc 5 so the threaded insert hangs directly below the lag screw 8.

If the user has metal stud walls, the lag screws 8 are replaced with toggle bolts, with drilling the required hole size.

The user installs one set screw 6 in each disc 5, with the pointed end facing out, and screws them in fully so the amount projecting is equal.

Holding the shelf 3 approximately level, and with the rear edge 3*a* over the projecting points of set screws 6, the user presses or taps the front edge so the points make an impression in the rear edge 3*a* (see FIG. 2). It is noted that that for this step, the shelf 3 need only be level enough so the rear edge 3*a* covers all projecting points. For longer shelves, the user enlisting the help of a friend will ensure that the shelf 3 remains in place and the marks properly imparted.

Using a square 12, the user draws a perpendicular line L1 and L2 at each mark on the rear edge 3*a* of the shelf as shown in FIG. 3. With an awl or other pointed tool, the user impresses a mark MP1 and MP2 on each of these lines L1 and L2 at the mid-point of the shelf's thickness. At each of these locations, the user drills a 1¼ inch counterbore 14, 5/16-⅜ inch deep. If the user does not have a drill this size, the user can rout or chisel a larger pocket to the same depth.

The user replaces the shelf 3 against the wall 2, positioned so the mounting discs 5 fall into the counterbores 14 and again presses or taps the front edge so the points make an impression 15 in the bottom of the counterbores 14.

The user removes the shelf 3 and at the new screw point impressions 15, drills 7/16 inch holes, 3¼ inch - 3½ inch deep (or slightly deeper than the length of the hex posts 7 being used), as shown in FIG. 4. So the shelf 3 will rest perpendicular to the wall 2, the user ensures that these holes are parallel to the shelf's surface. The user uses a drill press with the shelf clamped vertically on edge, or with an electric drill fitted with a level.

It is noted that: If the user has made the user's shelf 3 narrower than 4 inches, the depth of the drilled hole should be reduced by however much narrower than 4 inches it is.

The user fastens a hex post 7 onto each projecting set screw 6 and firmly (but not excessively) tighten. This tensions the set screw 6, ensuring that the post 7 will remain square to the disc 5, even if the disc 5 should even loosen slightly from the wall. The user uses locking pliers to prevent the mounting discs 5 from rotating while tightening.

The user slides the shelf 3 over the hex posts 7 until the back edge 3*a* contacts the wall 2. To prevent inadvertent bending or overstressing of the posts 7, the user keeps the shelf 3 approximately parallel to the wall 2 as it is installed.

Installation Instructions for Mounting Plate 20

The shelf 3 should be at least 1 inch thick, or not less than 1⅛ inch in order to fully conceal the baseplates 20. Anything thicker than 1¼ inch will make a needlessly heavy (and load robbing) shelf. An overview of the system is shown in FIG. 6.

The shelf 3 may be up to 8 inches deep, made with a solid piece or built-up from two pieces and laminated together. If using a solid piece, the user will need a 7/16 inch drill bit capable of making holes 15 5¼ inches deep (or slightly deeper than the length of the hex posts 7 being used). If using a built-up piece, the user will need to rout blind grooves to accommodate the posts 7, then glue them together. Both methods are utilized.

The shelf 3 should be at least 18 inches long in order to span a pair of wall studs 1 spaced 16 inches apart, but can be as long as the user wishes. Remember that load-bearing capacity can be increased on shelves longer than 34 inches by adding additional supports at each stud 1 that the shelf 3 overlaps.

It is noted that based on 5 inch long hex posts 7, for shelves narrower than 5¼ inches, the user will have to cut some of the non-threaded end of the hex post 7 (with a hacksaw), so the posts 7 are roughly ⅜ inch shorter than the shelf's depth.

For installation, the user uses a stud finder or rare-earth magnet over the approximate area where the user wishes to mount the shelf 3. Using a rare-earth magnet with a light touch, the user will feel when the magnet picks up on a drywall screw. When it does, the user temporarily marks its position with a light pencil mark or piece of tape. The user measures 16 inches over (or any multiple of), and again uses the magnet to find a screw. Locating another at 16 inches (or any multiple thereof) from the first mark ensures that the user has found the studs and not any errant screws.

If the user uses only two shelf supports, mark two studs 1 whose spacing is as close to the shelf length as possible, less 2 inches.

EXAMPLES 24 inch shelf: 24 inches−2 inches=22 inches mark two studs 16 inches apart 36 inch shelf: 36 inches−2 inches=34 inches mark two studs 32 inches apart 48 inch shelf: 48 inches−2 inches=46 inches mark two studs 32 inches apart The user holds a baseplate 20 centered over one of the marks, orienting it as shown in FIG. 6. Drill a ⅛ inch pilot hole 1¼ inch to 1½ inch deep for only one of the two mounting holes. Using this pilot hole, the user secures the baseplate 20 using a #8×1½ inch (or longer) flat-head screw 21 and tightens the screw 21 so the baseplate 20 is just free from rotating.

If the user has metal stud walls, preferably #8 flat-head machine screws are used with toggle bolts.

The user repeats the steps for the baseplate 20 that will support the opposite end of the shelf 3, ensuring that the pair form a level line.

The user levels both mounted baseplates 20. The easiest way to do this is to hold a straight edge that spans both, adjusting the baseplates 20 so their long edge fully contacts the straight edge. The user firmly tightens the installed screw 21 in each, then drills a similar pilot hole in the remaining open hole in each baseplate 20, and secures it with another screw.

If the user uses more than two baseplates 20 to increase load bearing capacity, the user installs them now into the intermediate studs. Again the user uses a straightedge spanning the two outermost baseplates 20 so that they are installed at the correct height and level.

The user installs one set screw 6 in each baseplate 20, with the pointed end facing out, screws them in fully so the amount projecting is equal.

If using a built-up shelf, the user temporarily clamps the two pieces together. Holding the clamped (or solid) shelf approximately level, and with the rear edge centered over the projecting points, the user presses or taps the front edge so the points make an impression into the rear edge. For longer shelves, enlisting the help of a friend will ensure that the shelf remains centered over the points, and the marks properly imparted. Using a square, the user draws a perpendicular line at each mark as shown (see FIG. 7).

5) For a Solid Shelf:

If the impressed mark is not at the mid-point of the shelf's thickness, the user uses an awl or other point tool to re-impress the marks at the mid-point. At these marks, the user drills 7/16 inch holes 15, 5¼ inches deep (or slightly deeper than the length of the hex posts 7 being used). It is noted that for shelves 3 narrower than 5¼ inches, the depth of the hole 15 should be to within ¼ inch of the front edge. So the shelf 3 will rest perpendicular to the wall 2, the user ensures that these holes 15 are parallel to the shelf's surface and uses a drill press with the shelf 3 clamped vertically on edge, or with an electric drill fitted with a level.

For a Built-Up Shelf:

The user makes a mark on each piece 25 identifying the outer faces and unclamps the two pieces. On the centers of the lines marked on the rear edges, the user routs ½ inch wide grooves 26 on the inner faces, 7/32 inch deep, extending 5¼ inches from the rear edge of the shelf, or to within ¼ inch of the front edge for shelves narrower than 5¼ inches (see FIG. 8).

The user dry fits the pieces 25 together and checks that the posts 7 slide into the pockets 26, even if they are oriented across corners (see FIG. 9). The user re-routs deeper if required.

In order for the shelf to fully conceal the baseplates, the user should rout or dado a ⅛ inch deep×1 inch wide×2 inches long pocket centered about the holes, or, a 1 inch wide center groove along the entire rear edge of the shelf.

The user laminates the two pieces 25 together, ensuring the rear edge and ½ inch wide routed grooves are aligned. The user trims the shelf ends flush if required, and planes the front edge smooth.

The user fastens a hex post onto each projecting set screw and firmly tightens it. This tensions the set screw, ensuring that the post will remain square to the baseplate.

The user slides the shelf 3 evenly over the hex posts 7 until the back edge 3*a* contacts the wall 2.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A blind shelf support system for attaching a shelf to a wall having studs, wherein said shelf is attached to said wall without any visible means of shelf attachment, comprising:

at least one shelf with a flat upper surface, a thickness, and at least one rear edge, said at least one rear edge being disposed flush against and extending perpendicularly from the surface of a stud-bearing wall; wherein said at least one rear edge having a pair of opposite ends, wherein the distance between said opposite ends of said at least one rear edge having a total spaced-apart length at least sufficient to over-extend the distance between a pair of adjacent studs in said stud-bearing wall by a distance about at least ⅛ the distance between adjacent wall studs; and wherein said blind shelf support system having at least one pair of elongated post apertures extending perpendicularly from said at least one rear edge into said shelf, said at least one pair of post apertures having an access opening at said at least one rear edge; and wherein said at least one pair of post apertures being laterally spaced apart in register with said at least one pair of adjacent wall studs in said stud-bearing wall and wherein said blind shelf support system having at least one pair of elongated support posts, said support posts being attached to said at least one pair of adjacent wall studs by attachment means, said support posts extending horizontally outward from said wall and perpendicularly to said at least one rear edge of said shelf, wherein said at least one pair of support posts fit snugly within said post apertures for hidden load-bearing support of said shelf; and wherein said at least one pair of support posts has, respectively, a front end concealed within said at least one pair of post apertures and a rear end having threaded attachment means, said respective rear ends of said at least one pair of support posts being threadably attached to said support post attachment means; and wherein said at least one pair of post apertures have a diameter of from about 20% to about 30% of the dimension of said thickness of said at least one shelf, and wherein said at least one rear edge of said shelf has at least one mounting hardware recess, said hardware mounting recess surrounding a mounting means as well as surrounding said respective open ends of said respective at least one pair of post apertures; and wherein said blind shelf support system having at least one pair of wall-stud-attachment brackets, said brackets being respectively secured to said at least one pair of wall studs by securing means, and wherein said brackets are in positional register with said at least one hardware mounting recess on said at least one rear edge of said shelf, and wherein said brackets are attached to said respective at least one support post; wherein said at least one pair of wall-stud-attachment brackets comprise said attachment means for attaching said support posts to said at least one pair of adjacent wall studs; and wherein said at least one pair of hardware mounting recesses are of sufficient depth to accommodate said at least one pair of wall-stud-attachment brackets together with hardware means for attaching said brackets to said respective at least one pair of wall studs, as well as accommodating said threaded attachment means for attaching said at least one pair of support posts to said brackets, so that when said shelf is installed said at least one pair of wall stud attachment brackets, said hardware means for securing said brackets to said wall studs, and said at least one pair of support posts are concealed with said hardware mounting recess of said at least one rear edge of said shelf, said rear edge of said shelf being flush with said wall when said blind shelf support system is installed.

2. The blind shelf support system of claim 1, wherein further, said shelf is a straight rectangular shelf with a single rear edge; and said shelf thickness is from about 1.33 inches to about 2.67 inches; and said shelf has a width of from about 6 inches to about 9 inches; and said at least one pair of post apertures extending perpendicularly from said rear edge of said shelf a distance of from about 4.5 inches to about 5.5 inches deep into said shelf; and wherein the diameters of the respective said at least one pair of post apertures is from about 0.25 inches to about 0.75 inches; and wherein said at least one pair of snugly fitting support posts within said post apertures have about the same length and cross section as the respective corresponding length and diameter of said post apertures; and wherein said at least one pair of wall-stud-attachment brackets comprises a respective at least one pair of disks wherein each respective disk has a pair of respective apertures, respectively comprising an upper aperture and a lower aperture, and wherein said upper aperture is a wall stud-affixation aperture of said bracket for accepting a lag-screw-and-washer combination therethrough for affixing said bracket to a wall stud, wherein the threads of said lag screw extend through said upper aperture and engage a wall stud and wherein the head of said lag screw and said washer engage said bracket as to urge said bracket and said wall stud fixedly together, and wherein the head of said lag screw and said washer project outwardly from said wall and are accommodated by said hardware mounting recess of said rear edge of said shelf, wherein said head of said lag-screw-and-washer combination remain in contact with said disk-shaped wall stud-attachment brackets, thereby affixing said disk-shaped stud-attachment brackets to said wall stud; and wherein said lower aperture of said disk-shaped stud-attachment brackets comprises a threaded aperture for threadably accepting means for locating and for attaching said at least one pair of support posts, wherein further said threaded lower aperture of said disk-shaped wall stud-attachment brackets is provided with at least one respective pair of threadedly-attached pointed support-post attachment set screws, said set screws being elongated cylinders with external threading extending longitudinally along the length thereof, said post-attachment set screws having a pointed end extending outwardly from said wall and wherein said at least one pair of pointed attachment set screws further comprises a pair of locators to permit a shelf-installer to tap said rear edge of an undrilled as yet un-installed shelf gently against said outwardly extending points of at least one pair of pointed attachment set screws for creating a precisely positioned pair of indentation marks on the rear edge of said shelf to permit said shelf installer to scribe said positioned pair of indentation marks to make drill-hole-locator marks on said rear edge of said shelf for permitting the installer to drill said rear edge of said shelf with a precisely positioned pair of said support post apertures laterally into said rear edge of said shelf; and wherein said at least one pair of support posts respectively have a rear end disposed closest to said rear end of said shelf said support post rear ends respectively having a threaded aperture for threadedly affixing to said longitudinally extending external threading of said pointed support-post attachment set screws.

3. The blind shelf support system of claim 2 wherein said at least one pair of support posts respectively have a hexagonal cross-section; and wherein said shelf thickness is from about 1.33 inches to about 2.67 inches; and said shelf has a width of from about 6 inches to about 8 inches; and said at least one pair of post apertures extending perpendicularly from said rear edge of said shelf a distance of about 5.5 inches deep into said shelf; and wherein the diameters of the respective said at least one pair of post apertures is from about 0.40 inches to about 0.50 inches; and wherein said at least one mounting hardware recess comprises a respective at least one pair of spaced-apart circular counterbores, wherein said counterhores have a diameter no greater than 75% of the width of said rear edge of said shelf; and wherein said at least one pair of support posts and said at least one pair of wall-stud-attachment brackets are made of a strong material.

4. The blind shelf support system of claim 3 wherein said support posts apertures have a diameter of about 7/16 inches and said hexagonal cross-section support posts have a cross-sectional length of about 7/16 inches; and wherein said at least one pair of support posts and said at least one pair of wall-stud-attachment brackets are made of steel.

5. A method of blind-supporting a wall, shelf upon a stud-bearing wall without visible support hardware, comprising the steps of:

a. selecting a piece of stock to serve as a shelf;

b. selecting a section of stud-bearing wall where shelf is to be affixed;

c. affixing at least one pair of disk-shaped wall-stud-attachment brackets wherein said brackets are made of a strong material and are provided with a pair of respective apertures, respectively comprising an upper aperture and a threaded lower aperture, wherein said upper aperture is a wall stud-affixation aperture of said bracket for accepting a lag-screw-and-washer combination and said lower aperture is threaded for threadably accepting a pointed elongated set screw, by lag-bolting said at least one pair of disk-shaped wall-stud-attachment brackets with a lag bolt inserted into said upper aperture so that said lag bolt engages with respective wall studs, thus affixing said attachment bracket to said wall studs;

d. threadably inserting a pointed-head set screw into each respective said lower aperture of said respective attachment brackets, ensuring that the pointed ends thereof are extending outwardly from said wall, and tightening said set screws into said lower bracket aperture;

e. carefully aligning said selected shelf stock so as to position a rear edge thereof in centered alignment relatively to said outwardly extending at least two pointed set screws;

f. lightly tapping said positioned shelf stock against said at least two set screw points so as to create set screw point indentations upon said rear edge of said shelf stock in at least a pair of positions corresponding to the exact locations of said set screw points;

g. removing said shelf stock and examining the indentation marks produced by said set screw points;

h. using a tri-square or other carpentry squaring device to scribe the locations of the set screw indentations;

i. counterboring the rear edge of said selected shelf stock in positional register with said set screw indentations;

j. drilling support post extension apertures into the counterbored area of said rear edge of said shelf stock in positional register with said set screws;

k. threadedly attaching a respective pair of support posts with threaded apertures in a rear end thereof by matching and attaching said rear threaded apertures with said threaded set screws that are tightly installed onto said lower aperture of said attachment bracket; and l. assembling said shelf by matching the support posts to said drilled support post apertures and applying pressure to said shelf stock inwardly in the direction of said wall surface so that said support posts fully seat themselves in said support post apertures and said rear edge of said shelf stock is flush with said wall.

6. The method of claim 5 wherein said shelf is a straight rectangular shape having a thickness of about 2 inches and wherein said drilled support post apertures have a diameter of about 7/16 inches and extend into said shelf from a rear edge thereof by about 5 inches, said shelf having a width of about 6 inches; and wherein said wall-stud-attachment brackets are made of steel; and wherein said support posts comprise hexagonal cross-section posts made of steel.

7. A blind shelf support system for attaching a shelf to a wall having studs, wherein said shelf is attached to said wall without any visible means of shelf attachment, comprising:

a shelf having a rear edge, said rear edge being adapted for contacting said wall, wherein said shelf rear edge has at least two recesses therewithin, said recesses created at respective locations on said rear edge; and pointed means extending outwardly from and supported by pre-fastened mounting plates attached to said wall at said stud locations for fixing the location of said recesses by indenting said rear edge of said shelf thereby accurately marking said rear edge, said recesses comprising hardware mounting chambers for installing shelf-mounting hardware within said shelf, while permitting said rear edge of said shelf to fit flush against said wall, thereby hiding said mounting hardware of said shelf from view.

8. The blind shelf support system as in claim 7 wherein said pointed means are pointed set screws extending outwardly from the surface of said mounting plates in threaded holes, said set screws serving the dual purpose as coupling screws to attach said shelf mounting hardware comprising posts, each with a blind threaded hole at the mounting end to said mounting plates.

9. A blind shelf support system for attaching a shelf to a wall having studs, wherein said shelf is attached to said wall without any visible means of shelf attachment, comprising:

a shelf having a rear edge, said rear edge being adapted for contacting said wall, wherein said shelf rear edge has at least two recesses therewithin, said recesses created at respective locations on said rear edge;

pointed means extending outwardly from pre-fastened mounting plates attached to said wall at said stud locations for fixing the locations of said recesses by indenting said rear edge of said shelf thereby accurately marking said rear edge, said recesses comprising hardware mounting chambers for installing shelf-mounting hardware within said shelf, while permitting said rear edge of said shelf to fit flush against said wall, thereby hiding said mounting hardware of said shelf from view;

said at least one rear edge having a pair of opposite ends, wherein the distance between said opposite ends of said at least one rear edge having a total spaced-apart length at least sufficient to over-extend the distance between a pair of adjacent studs in said studs-bearing wall by a distance about at least 1/8 the distance between adjacent wall studs; and wherein said blind shelf support system having at least one pair of elongated post apertures extending perpendicularly from said at least one rear edge into said shelf, said at least one pair of post apertures having an access opening at said at least one rear edge; and wherein said at least one pair of post apertures being laterally spaced apart in register with said at least one pair of adjacent wall studs in said stud-bearing wall and wherein said blind shelf support system having at least one pair of elongated support posts, said support posts being attached to said at least one pair of adjacent wall studs by attachment means, said support posts extending horizontally outward from said wall and perpendicularly to said at least one rear edge of said shelf, wherein said at least one pair of support posts fit snugly within said post apertures for hidden load-bearing support of said shelf; and wherein said at least one pair of support posts has, respectively, a front end concealed within said at least one pair of post apertures and a rear end having threaded attachment means, said respective rear ends of said at least one pair of support posts being threadably attached to said support post attachment means; and wherein said at least one pair of post apertures have a diameter of from about 20% to about 30% of the dimension of said thickness of said at least one shelf; and wherein said at least two hardware mounting chambers surrounding respective mounting means as well as surrounding said respective open ends of said respective post apertures; and wherein said blind shelf support system having at least one pair of said mounting plates said mounting plates being respectively secured to said at least one pair of wall studs by securing means, and wherein said mounting plates are in positional register with said at least two hardware mounting chambers on said at least one rear edge of said shelf, and wherein said mounting plates being attached to said respective at least one support post; wherein said at least one pair of said mounting plates comprise said attachment means for attaching said support posts to said at least one pair of adjacent wall studs; and wherein said at least two hardware mounting chambers are of sufficient depth to accommodate said at least one pair of said mounting plates together with hardware means for attaching said mounting plates to said respective at least one pair of wall studs, as well as accommodating said threaded support posts for attaching said at least one pair of said support posts to said mounting plates, so that when said shelf is installed said at least one pair of said mounting plates, said hardware means for securing said mounting plates to said wall studs, and said at least one pair of said support posts are concealed with, said at least two hardware mounting chambers of said at least one rear edge of said shelf, said rear edge of said shelf being flush with said wall when said blind shelf support system is installed.

10. The blind shelf support system as in claim 7 wherein shelf is made of a pair of half shelf pieces joined together.

11. A blind shelf support system for attaching a shelf to a wall having studs, wherein said shelf is attached to said wall without any visible means of shelf attachment, comprising:

a shelf having a rear edge, said rear edge being adapted for contacting said wall, wherein said shelf rear edge has at least two spaced recesses;

mounting plates on said wall directly opposite studs;

each mounting plate having means to attach said plate through said wall to an underlying stud, and a threaded opening;

a threaded screw in each threaded opening, each threaded screw having an outwardly extending point to mark said rear edge of said shelf for drilling, a hole;

a support post having a distal end with a threaded aperture for engaging each threaded screw in said mounting plate; and a proximal end of said support post extending into each said hole in said rear edge of said, shelf, permitting said rear edge of said shelf to fit flush against said wall, with said recesses enclosing and hiding all mounting hardware of said shelf from view.

* * * * *